US007185388B2

(12) United States Patent
Sander

(10) Patent No.: US 7,185,388 B2
(45) Date of Patent: Mar. 6, 2007

(54) POWER WAVE FLOOR SQUEEGEE AND HANDLE CONNECTOR

(75) Inventor: Don L. Sander, Fairfield, IA (US)

(73) Assignee: Harper Brush Works, Inc., Fairfield, IA (US)

( * ) Notice: Subject to any disclaimer, the term of this patent is extended or adjusted under 35 U.S.C. 154(b) by 347 days.

(21) Appl. No.: 10/213,670

(22) Filed: Aug. 6, 2002

(65) Prior Publication Data

US 2004/0025278 A1 Feb. 12, 2004

(51) Int. Cl.
*A47L 13/11* (2006.01)

(52) U.S. Cl. ..... 15/245

(58) Field of Classification Search ..... 15/245, 15/245.1

See application file for complete search history.

(56) References Cited

U.S. PATENT DOCUMENTS

| | | | | |
|---|---|---|---|---|
| 72,993 | A * | 1/1868 | Fleckenstein | 15/245 |
| 300,447 | A * | 6/1884 | Cornelius | 15/245 |
| 1,720,630 | A | 7/1929 | Eiermann | |
| 1,789,636 | A | 1/1931 | Oberti | |
| 1,918,611 | A | 7/1933 | Oberti | |
| 2,081,735 | A * | 5/1937 | Caronia | 15/245.1 |
| 3,119,138 | A * | 1/1964 | Davis | 15/245.1 |
| 3,137,879 | A * | 6/1964 | Dootson | 15/245.1 |
| 3,787,921 | A * | 1/1974 | Feldmann | 15/105 |
| 5,117,530 | A | 6/1992 | Rank | |
| 5,347,676 | A | 9/1994 | Saitoh | |
| 5,528,793 | A | 6/1996 | Schbot | |
| 5,778,482 | A | 7/1998 | Sbrigato | |
| 6,243,911 | B1 * | 6/2001 | Varner | 15/245 |
| 6,668,418 | B2 * | 12/2003 | Bastien | 15/245 |

FOREIGN PATENT DOCUMENTS

EP 0 011 055 * 5/1980

* cited by examiner

*Primary Examiner*—Randall Chin
(74) *Attorney, Agent, or Firm*—Welsh & Katz, Ltd

(57) ABSTRACT

One embodiment of the improved squeegee has a front deflector bar, and a plurality of material folding devices that are oriented and positioned on the front deflector bar such that the material encountering the front deflector bar is folded back onto material not yet encountered by the front deflector bar. The front deflector bar has an inside wall with a predetermined configuration and the material folding devices extend from this inside wall. The material folding devices may extend substantially perpendicular from the inside wall or at other angles. The improved squeegee may also have a back support section and a blade. The front deflector bar may be operatively connected to the back support section. The blade may be secured at least partially between the back support section and the front deflector bar.

10 Claims, 5 Drawing Sheets

POWER WAVE FLOOR SQUEEGEE AND HANDLE CONNECTOR

FIELD OF THE INVENTION

The present invention relates to squeegees, and more particular to squeegees used for sweeping up liquids and similar materials from floors.

BACKGROUND

Conventional squeegees typically have a base section which extends along a surface to be cleaned, such as the surface of a floor, and is attached to the lower end of an elongated handle. These squeegees also typically have a blade composed of rubber or similar material that has a flexible characteristic. The blade is typically disposed on the base section and extends from a lower portion of the base section in order to contact the floor.

These conventional squeegees operate to sweep up water or similar materials on the surface of a floor utilizing the flexibility of the blade. However, the drawback with such conventional squeegees is that the liquid that builds up in front of the base section may flow over the base section and around end portions of the base section. These conventional squeegees force the liquid in front of the base section to take the path of least resistance when being displaced, pushed or moved. The displaced liquid forms a fan pattern with only a portion of the liquid going in the intended direction, for example some portions will slide off the end of the base section and be left behind. Depending upon the force of the forward stroke, the liquid may climb the face of the squeegee and fly upward as the tool passes underneath.

Other known squeegees have end portions of the base section bent forward such that the liquid tends to be more trapped in front of the base section. However, as the liquid builds up, the liquid will eventually flow around the end portions of the squeegee base section.

Thus, there is a need in the prior art for an improved floor squeegee, which eliminates the need for curved or bent up portions along the base section of the squeegee, (this resulting in lower manufacturing costs). There is also a need in the prior art for a squeegee, which is more efficient in collecting fluids and other materials.

BRIEF DESCRIPTION OF THE DRAWINGS

The features of the present invention which are believed to be novel are set forth with particularity in the appended claims. The invention may best be understood by reference to the following description taken in conjunction with the accompanying drawings, in the several figures of which like reference numerals identify like elements, and in which:

DETAILED DESCRIPTION

Figure 1:
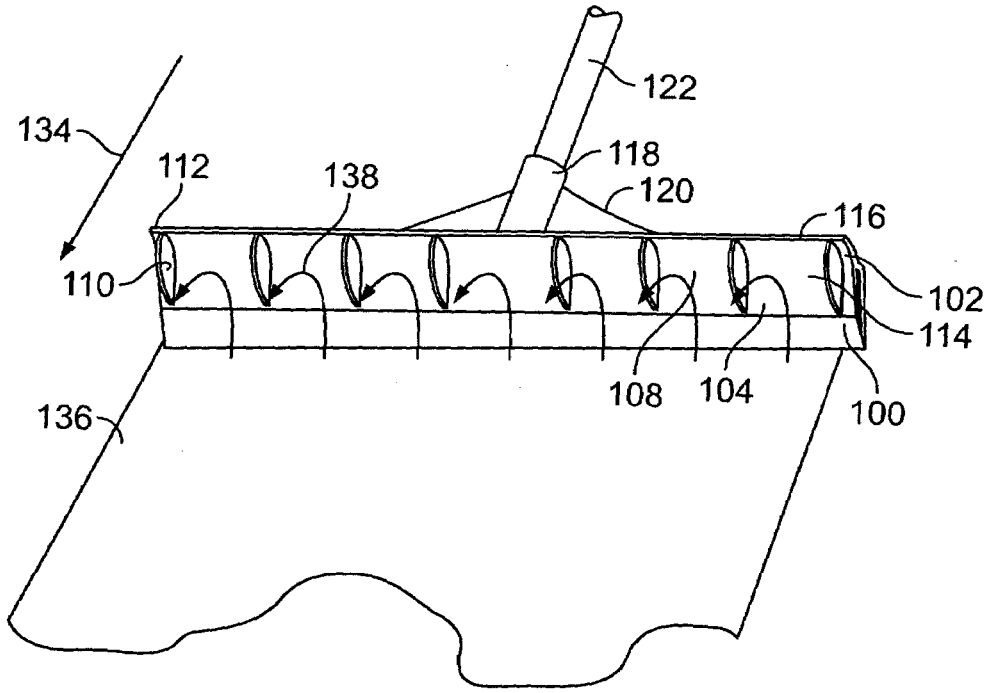
FIG. 1 is a perspective view of an embodiment of the improved squeegee.

While the present invention is susceptible of embodiments of various forms, they are shown in the drawings, and will hereinafter be described, some exemplary and non-limiting embodiments, with the understanding that the present disclosure is to be considered an exemplification of the invention. It is not intended to limit the invention to the specific embodiments illustrated.

In general terms, an embodiment of the improved squeegee has a front deflector bar, and a plurality of material folding devices that are oriented and positioned on the front deflector bar such that the material encountering the front deflector bar is folded back onto material not yet encountered by the front deflector bar. The front deflector bar has an inside wall with a predetermined configuration and the material folding devices extend from this inside wall. In one embodiment the material folding devices may extend substantially perpendicular from the inside wall.

The improved squeegee may also have a back support section and a blade. The front deflector bar may be operatively connected to the back support section. The blade may be secured at least partially between the back support section and the front deflector bar.

The improved squeegee may be used to move or remove liquids, fluids and semi-liquids from floors. The improved squeegee may also be used with other types of materials, such as snow, ice and powders, including flour or concrete dust.

An embodiment of the improved squeegee is depicted in FIG. 1. In this embodiment a blade 100 is secured between a back support 102 and a front deflector bar 104. The front deflector bar 104 may have a plurality of material folding devices such as fins 106. The front deflector bar 104 also has an inside surface 108 which has a predetermined configuration. In the embodiment depicted in FIG. 1, the inside surface 108 is substantially concave. Also in this embodiment, the fins 106 are oriented substantially vertical and parallel to one another, and extend substantially perpendicular from the inside wall 108.

The embodiment depicted in FIG. 1 may also have a first fin 110 in a first area 112 of the front deflector bar 104, and a second fin 114 in a second area 116 of the front deflector bar 104. The first fin 110 in the first area 112 is one end of the front deflector bar 104, and the second fin 114 in the second area 116 is on the opposite end of the front deflector bar 104. The fins 106 may also be evenly spaced along the front deflector bar 104 as depicted in FIG. 1, or may have other spacing patterns. The fins 106 may be identical in shape, or different fins 106 may have different shapes.

The fins 106 may also have other shapes and configurations than the configuration depicted in FIG. 1, may be orientated other than perpendicular to the inside wall 108 of the front deflector bar 104. The fins 106 may be integrally molded with the front deflector bar 104 or may be attached to the front deflector bar 104 by other means, such as gluing, bolting, etc. The front deflector bar 104 and the fins 106 may be made from a variety of materials, such as plastics, metal, etc.

Figure 2:
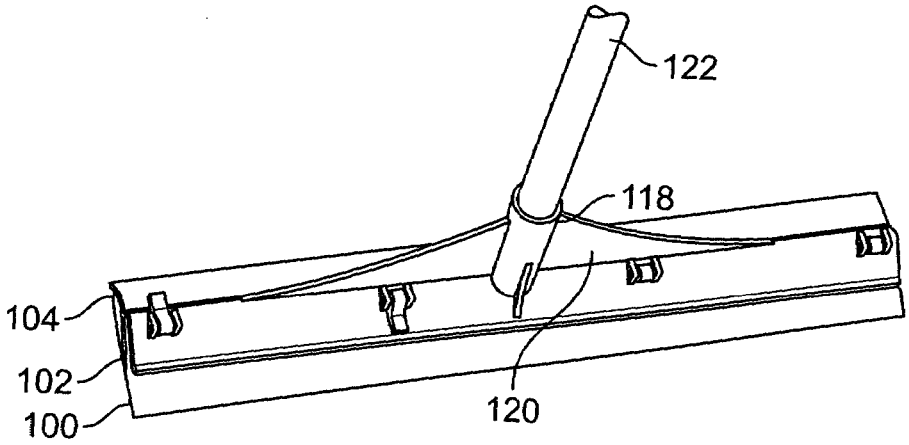
FIG. 2 is a perspective rear view of one embodiment of the improved squeegee.

The embodiment of the improved squeegee depicted in FIG. 1 has a back support section 102, which is more clearly seen in FIG. 2. As previously described, the blade 100 is at least partially secured between the back section 102 and the front deflector bar 104. It is to be understood that when the term "partially secured" is used in this context, it is to be understood that the blade 100 may be actually held by the back support section 102 or the front deflector bar 104, but in very general terms is typically located between the front deflector bar 104 and the back support section 102. The blade 100 may also be attached to an outside surface of the back support section 102 or to a front side of the front deflector bar 104.

As depicted in FIGS. 1 and 2, the improved squeegee may have a handle connector 118, which may be reinforced with struts 120. In the embodiment depicted in FIGS. 1 and 2 the handle connector 118 and the struts 120 are attached to the back support section 102. A handle 122 may be attached to the handle connector 118.

Figure 3:
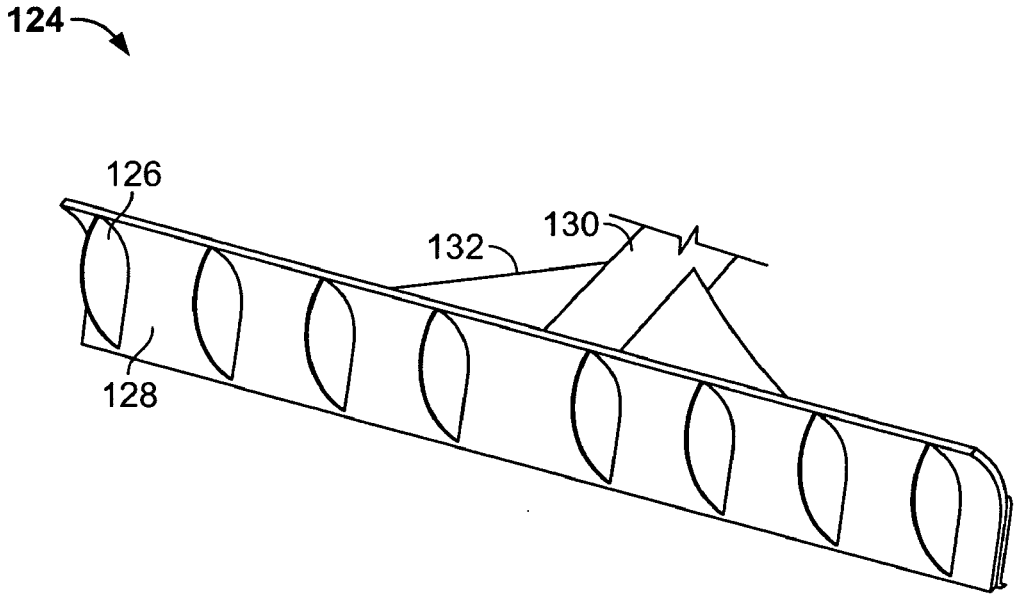
FIG. 3 is a perspective front view of the front deflector bar of one embodiment of the improved squeegee.
Figure 4:
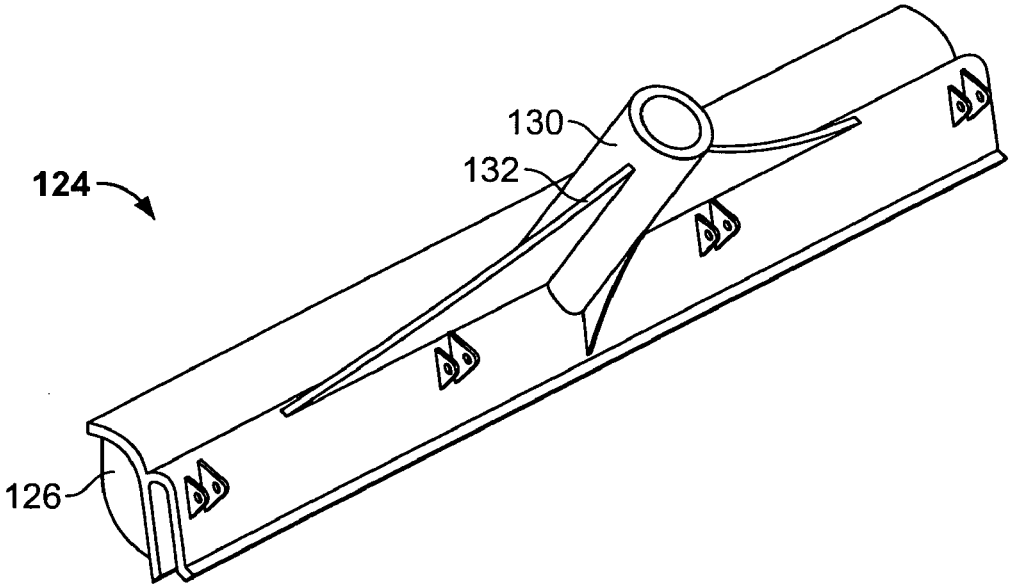
FIG. 4 is a rear view of the front deflector bar depicted in FIG. 3.

As depicted in FIGS. 3 and 4, the back support section and the front deflector bar may form a one-piece unit 124. The one-piece unit 124 has fins 126 extending from an inside surface 128 of the assembly 124. Again, the assembly 124 may have a handle connector 130 and struts 132 for attaching the assembly 124 to a handle (not shown).

Referring again to FIG. 1, when the improved squeegee is moved forward along a floor, such as in the direction of arrow 134, a material, such as water 136, is collected along the front inside surface 108 of the front deflector bar 104. The fins 106 cause the water 136 to fold back onto itself. That is, water 138, which has already encountered the front deflector bar 104, is folded back onto the water 136, which has not yet encountered the front deflector bar 104. The fins 106, including the first and second fins 110, 114 in the end areas 112, 116 of the front deflector bar 104 contain the water and give the water directional control eliminating any water from sliding off the end areas 112, 116 of the front deflector bar 104. This improved design of the squeegee increases cleaning efficiency and effectiveness by taking advantage of the physics of moving materials, such as liquids and semi-liquids. Because the liquid control is directed along a straight front deflector bar 104, the improved squeegee can be turned over so that the other side of the front deflector bar 104 (which may include a second blade) may be used to further clean the floor.

The improved squeegee may be formed from nylon or polypropylene materials, which allow use of the squeegee in temperature ranges, for example, from −30 degrees Fahrenheit to +180 degrees Fahrenheit. Of course, by utilizing other materials for forming the improved squeegee more extreme conditions could be encountered. The improved squeegee is unique in that it folds liquids and semi-liquids in front of the squeegee increasing the amount of material that is moved and controlled through a pushing motion.

Figure 5:
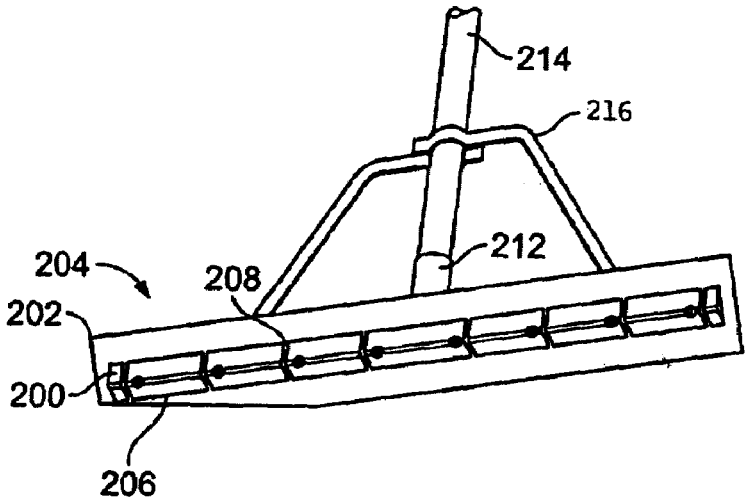
FIG. 5 is a perspective view of another embodiment of the improved squeegee.
Figure 6:
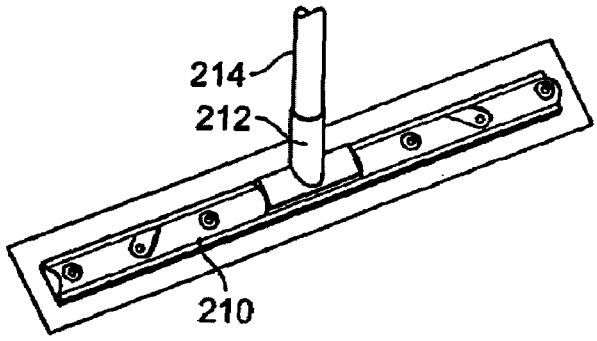
FIG. 6 is another perspective view of an alternative embodiment of the improved squeegee.

Another embodiment of the improved squeegee is depicted in FIG. 5 wherein a front deflector bar 200 has attached thereto a blade 202 having first and second sides 204 and 206. The front deflector bar 200 has a plurality of material folding devices, such as fins 208. The front deflector bar 200 is attached to a back support section 210, which is depicted in FIG. 6. A handle connector 212 may be used to secure a handle 214 to the back support section 210. As shown in FIG. 5, struts 216 may be utilized to further reinforce and strengthen the connection of handle 214 to the back support section 210.

Figure 7:
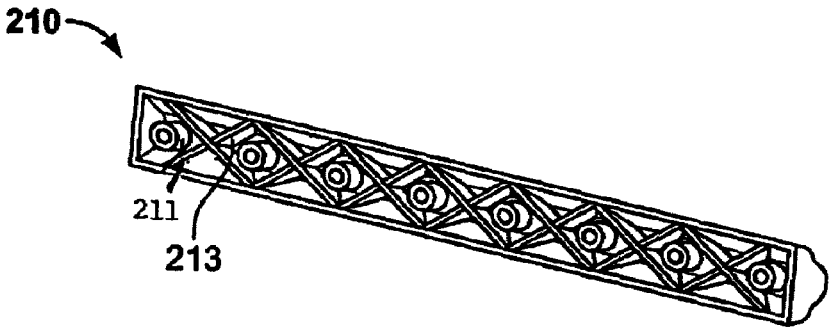
FIG. 7 is a front view of the back support of yet another embodiment of the improved squeegee.
Figure 8:
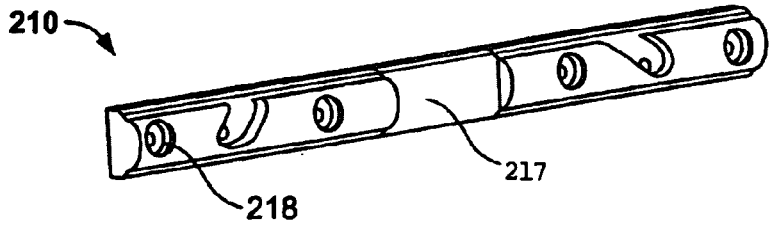
FIG. 8 is a back view of the back support depicted in FIG. 7.

The back support section 210 is also shown in FIGS. 7 and 8. In the embodiment depicted in FIG. 7, the inside of the back support section 210 is depicted and has attachment means 211 such as screw or bolt receiving openings for example, and has strengthening ribs 213. On the outside surface of the back support section 210 depicted in FIG. 8 there may be an area 217 for securing, attaching or placing the handle connector (attachment means) 212. Areas 218 may provide a countersunk area for nuts that may be attached to bolts, which extend through the openings of the back support section 210.

Figure 9:
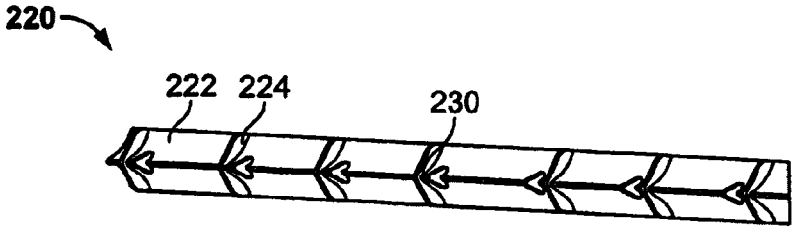
FIG. 9 is a perspective front view of the front deflector bar of another embodiment of the improved squeegee.
Figure 10:
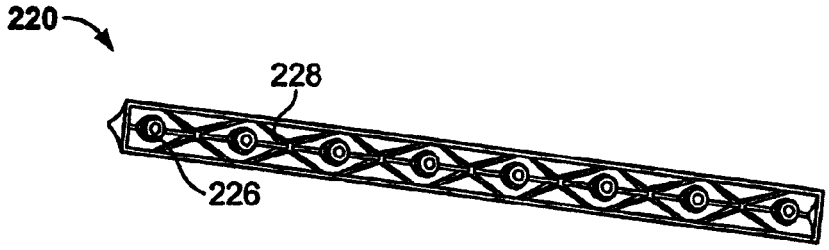
FIG. 10 is a perspective rear view of the front deflector bar depicted in FIG. 9.

An embodiment of a front deflector bar 220 is depicted in FIGS. 9 and 10. This front deflector bar 220 may be utilized with the back support section 210 depicted in FIGS. 7 and 8. In the FIG. 9 embodiment the front deflector bar 220 has an inside surface 222, which has a predetermined configuration. A plurality of material folding devices, such as fins 224, is spaced along the front deflector bar 220. As depicted in this embodiment the fins 224 may be evenly spaced along the front deflector bar 220. FIG. 10 shows a rear perspective view of the front deflector bar 220, which has attachment means, such as screw receiving portions 226 and strengthening ribs 228. The blade 202 is contained and secured between the front deflector bar 220 and the back support section 210 and may have bolts, screws or other devices extend through the blade such that the blade is held in place and extends from the assembled back support section 210 and front deflector bar 220. The front deflector bar 220 depicted in FIG. 9 also has openings 230 for receiving, for example, bolts that extend through the front deflector bar 220 and through the back support section 210 to be held in place by nuts.

Figure 11:
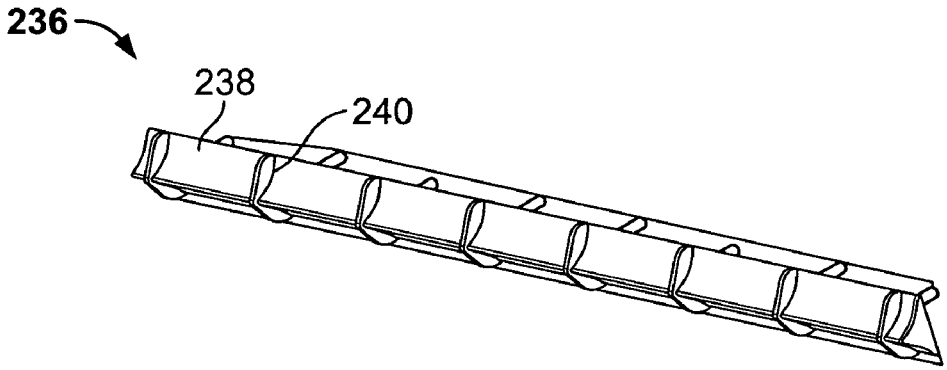
FIG. 11 is a front view of another embodiment of the front deflector bar in a further embodiment of the improved squeegee.
Figure 12:
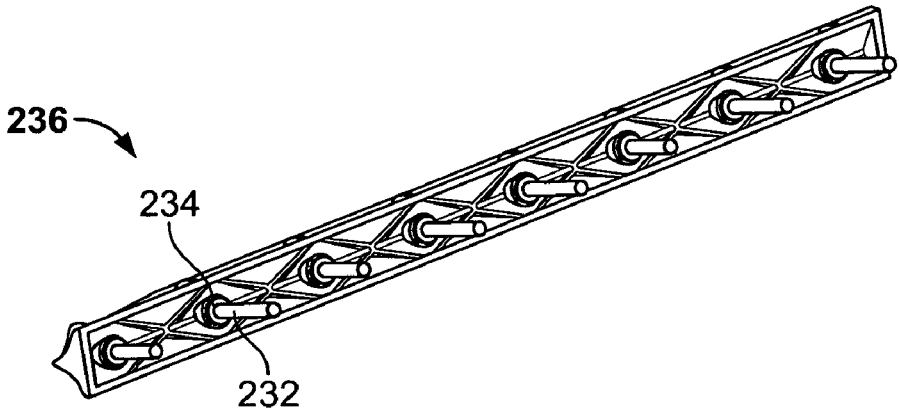
FIG. 12 is a back perspective view of the front deflector bar depicted in FIG. 11.

A further embodiment is depicted in FIGS. 11 and 12 in which bolts 232 are insert molded into receiving areas 234 on the inside of the front deflector bar 236 (see FIG. 12). In this embodiment, the inside surface 238 on the front of the front deflector bar 236 (See FIG. 11) is not interrupted with any recesses or bolt receiving openings. As previously described, the front receiving bar 236 may have a plurality material folding devices 240 that may be spaced evenly along the inside surface 236 of the front deflector bar 238. It is to be appreciated that other configurations of the inside surface 238 of the front deflector bar 236 may be utilized as well as other configurations and placement of the fins 240 along the front deflector bar 236.

The improved squeegee, while retaining the configuration of a straight front deflector bar, increases the efficiency of moving or removing materials, such as fluids and semi-fluids, from floors by taking advantage of the physics of such fluids. By causing the liquids and semi-liquids to fold back on themselves as the improved squeegee is pushed forward, the liquids and semi-liquids do not flow off the ends of the improved squeegee such as occurs in prior art squeegees. Of course the design of the improved squeegee may be utilized with a front deflector bar, which has the ends bent or curved. In such an embodiment the fins along the front deflector bar would still cause the liquids to fold back on themselves. The folding back of the liquid upon itself is referred to as a power wave.

The improved squeegee is lightweight and in one embodiment has an estimated total weight of only twenty-nine ounces as compared to prior art squeegees that typically have a weight of at least thirty-eight ounces. Lightweight means that a person using the squeegee becomes less tired over a period of time. It also increases cost savings since there are reduced shipping costs. The improved squeegee depicted in its various embodiments herein has a reduced number of component parts compared with prior art squeegees and thus results in savings in manufacturing and assembly costs. The improved squeegee may be made of materials such as plastic, nylon and polypropylene, which allow the incorporation of different colors and company logos for example. A cam lock design for securing the blade provides for ease of cleaning in food environments for example. It may also be spark proof for use in hazardous environments when formed from nonmetallic materials. The embodiments of the improved squeegee may be formed from all nonmetallic materials. Also the blade may be rotated for longer life of the blade.

As has been pointed out above, the improved squeegee may be formed from a variety of materials, such as plastic, metal, etc. The material folding devices of the improved squeegee may have a variety of configurations, such as planar, non-planer, or a combination of planar and non-planar, and may be oriented at different angles to the inside surface of the front deflector bar. The parts of the improved squeegee may be held together by a variety of different means, such as bolts, screws, gluing, etc. Furthermore, the blade may be an integral part of the improved squeegee, or may be removable as depicted in the various embodiments herein. The improved squeegee may be made in different sizes, such as hand held sizes for use on non-floor surfaces, as well as the embodiments depicted for use on a floor.

The present invention is not limited to the particular details of the apparatus depicted, and other applications are contemplated. Certain other changes may be made in the above-described apparatus without departing from the true spirit and scope of the invention herein involved. In general, the various embodiments of the system may have components, which are foreign from different types of materials and which may have different cross sectional configurations. It is intended, therefore, that the subject matter in the above depiction shall be interpreted as illustrative and not in a limiting sense.

What is claimed is:

1. A squeegee, comprising:

a back support section;

a blade;

a front deflector bar having opposing ends and a plurality of at least three spaced fins, the front deflector bar being generally planar and operatively connected to the back support section, and the blade being secured at least partially between the back support section and the front deflector bar, the front deflector bar having a planar wall; and the fins being substantially flat, extending out from the planar wall and at least one fin being positioned in the center of the front deflector bar and spaced from the ends such that material encountering the front deflector bar and the fins are folded back onto oncoming material not yet encountered by the front deflector bar.

2. The squeegee according to claim 1, wherein the fins are oriented substantially vertical and parallel to one another.

3. The squeegee according to claim 1, wherein the front deflector bar has first and second ends, and wherein a first fin of the plurality of fins is located in an area of the first end, and wherein a second fin of the plurality of fins is located in an area of the second end.

4. The squeegee according to claim 3, wherein the fins of the plurality of fins are substantially evenly spaced along the front deflector bar.

5. The squeegee according to claim 1, wherein the material is one of a fluid and a semi fluid.

6. A squeegee for clearing material on a floor, comprising:

a back support section;

a blade;

a front deflector bar having opposing ends and a plurality of at least three spaced fins there between, the front deflector being operatively connected to the back support section, the blade being secured at least partially between the back support section and the front deflector bar, the front deflector having a planar front surface;

a handle connector connected at least to the back support section;

struts connected between at least the back support section and a handle;

a the handle attached to the handle connector; and the fins being substantially flat, extending out from the planar front surface, and at least one fin being positioned in the center of the front deflector bar and spaced from the ends such that material encountering the front deflector bar and the fins are folded back onto oncoming material not yet encountered by the front deflector bar.

7. The squeegee according to claim 6, wherein the fins are oriented substantially vertical and parallel to one another.

8. The squeegee according to claim 6, wherein the front deflector bar has first and second ends, and wherein a first fin of the plurality of fins is located in an area of the first end, and wherein a second fin of the plurality of fins is located in an area of the second end.

9. The squeegee according to claim 8, wherein the fins of the plurality of fins are substantially evenly spaced along the front deflector bar.

10. The squeegee according to claim 6, wherein the material is one of a fluid and a semi fluid.

* * * * *